US012709981B2

(12) United States Patent
Koekemoer et al.

(10) Patent No.: US 12,709,981 B2
(45) Date of Patent: Aug. 18, 2026

(54) DRILLING AND BOLTING TOOL

(71) Applicant: Joy Global Underground Mining LLC, Warrendale, PA (US)

(72) Inventors: Renier Koekemoer, Sudbury (CA); Justin Barter, Algoma Mills (CA)

(73) Assignee: Joy Global Underground Mining LLC, Warrendale, PA (US)

( * ) Notice: Subject to any disclaimer, the term of this patent is extended or adjusted under 35 U.S.C. 154(b) by 409 days.

(21) Appl. No.: 18/070,037

(22) Filed: Nov. 28, 2022

(65) Prior Publication Data

US 2024/0175358 A1 May 30, 2024

Related U.S. Application Data

(60) Provisional application No. 63/283,909, filed on Nov. 29, 2021.

(51) Int. Cl.

| | |
|---|---|
| ***E21D 20/02*** | (2006.01) |
| ***E21D 20/00*** | (2006.01) |
| ***E21D 21/00*** | (2006.01) |

(52) U.S. Cl.

CPC ..... *E21D 20/02* (2013.01); *E21D 20/006* (2013.01); *E21D 21/006* (2016.01)

(58) Field of Classification Search

CPC ..... E21D 20/003; E21D 20/006; E21D 20/02; E21D 21/006

See application file for complete search history.

(56) References Cited

U.S. PATENT DOCUMENTS

| | | | | | |
|---|---|---|---|---|---|
| 4,040,329 | A * | 8/1977 | Ljungberg | F42D 1/10 | 86/20.15 |
| 4,079,592 | A | 3/1978 | Eakin | | |
| 4,101,141 | A * | 7/1978 | Mattila | E21D 20/003 | 279/19 |
| 4,158,520 | A | 6/1979 | Prebensen | | |
| 4,643,619 | A * | 2/1987 | Issakainen | E21D 20/006 | 405/303 |
| 4,708,533 | A * | 11/1987 | Leppanen | E21D 20/028 | 401/265 |

(Continued)

FOREIGN PATENT DOCUMENTS

| | | | | |
|---|---|---|---|---|
| AU | 2014200223 | A1 | 10/2014 | |
| CN | 113550770 | A | 10/2021 | |
| WO | WO-2021006802 | A1 * | 1/2021 | E21D 20/003 |

OTHER PUBLICATIONS

International Search Report and Written Opinion for Related Application No. PCT/US2022/051088 dated Feb. 27, 2023 (14 pages).

(Continued)

*Primary Examiner* — Janine M Kreck
(74) *Attorney, Agent, or Firm* — Husch Blackwell LLP

(57) ABSTRACT

A drilling and bolting tool includes a drill feed for driving a bit to form a hole in a rock surface, a cable feed system, and a resin system. The drill feed includes a frame and a drill head supported on the frame. The cable feed system is coupled to the drill feed, and the cable feed system includes a cable drive for driving a cable into the hole. The resin system includes a hose in fluid communication with a resin supply. The resin system further including a hose drive system for selectively extending the hose into the hole and retracting the hose from the hole.

19 Claims, 9 Drawing Sheets

(56) References Cited

U.S. PATENT DOCUMENTS

| | | | | |
|---|---|---|---|---|
| 5,597,267 | A | 1/1997 | Morrison et al. | |
| 7,416,033 | B2 | 8/2008 | Hinshaw et al. | |
| 9,187,873 | B2 * | 11/2015 | Nelson | E21D 11/152 |
| 9,284,839 | B2 | 3/2016 | Nelson | |
| 9,567,854 | B2 | 2/2017 | Nelson | |
| 9,828,855 | B2 * | 11/2017 | Nelson | E02D 5/80 |
| 10,253,628 | B2 | 4/2019 | Faulkner et al. | |
| 10,487,655 | B2 | 11/2019 | Faulkner et al. | |
| 10,669,848 | B2 | 6/2020 | Faulkner et al. | |
| 10,954,787 | B2 | 3/2021 | Faulkner et al. | |
| 11,156,217 | B2 | 10/2021 | Faulkner et al. | |
| 2015/0275667 | A1 * | 10/2015 | Comorge | E21D 20/003<br>405/259.5 |
| 2016/0305243 | A1 | 10/2016 | Nelson | |
| 2018/0016899 | A1 * | 1/2018 | Galler | E21B 19/20 |

OTHER PUBLICATIONS

Chilean Office Action for Application No. 202401593 dated Oct. 27, 2025 (3 pages including Statement of Relevance).

* cited by examiner

DRILLING AND BOLTING TOOL

CROSS-REFERENCE TO RELATED APPLICATION

The present application claims the benefit of prior-filed U.S. Provisional Patent Application No. 63/283,909, filed Nov. 29, 2021, the entire contents of which are incorporated by reference.

FIELD

The present disclosure relates to a drilling and bolting tool, and more particularly to an underground drilling and bolting tool.

In underground mining and construction, drill rigs perform drilling and bolting operations. One common use for a drill rig is to reinforce a roof or wall section with a reinforcement member (e.g., a rebar bolt). In order to perform drilling operations, the drill rig requires a supply of consumables.

SUMMARY

In one independent aspect, a drilling and bolting tool includes a drill head for driving a bit to form a hole in a rock surface, the drilling and bolting tool further including a cable feed system, and resin system.

In some aspects, the resin system includes a hose and a hose drive for inserting the hose into the hole, the hose being in fluid communication with a resin supply reservoir and the hose capable of conveying resin into the hole.

In some aspects, the cable feed system includes a device for driving a flexible cable into the hole, applying a tension on the cable, and a cutter for cutting the cable as a position outside of the hole to leave a portion of the cable having a desired length in the hole.

In another independent aspect, a drilling and bolting tool includes a drill head for driving a bit to form a hole in a rock surface, the drilling and bolting tool further including a cable feed system.

In some aspects, the cable feed system includes a device for driving a flexible cable into the hole, applying a tension on the cable, and a cutter for cutting the cable as a position outside of the hole to leave a portion of the cable having a desired length in the hole.

In another independent aspect, a drilling and bolting tool includes: a drill feed for driving a bit to form a hole in a rock surface, the drill feed including a frame and a drill head supported on the frame; a cable feed system coupled to the drill feed, the cable feed system including a cable drive for driving a cable into the hole; and a resin system including a hose in fluid communication with a resin supply, the resin system further including a hose drive system for selectively extending the hose into the hole and retracting the hose from the hole.

In some aspects, the cable feed system includes a hydraulic actuator for applying tension on the cable.

In some aspects, the cable feed system includes a cutter for cutting the cable at a position outside of the hole while leaving a portion of the cable within the hole.

In some aspects, the drilling and bolting tool further includes a consumables magazine supported on the frame, the magazine configured to store at least one of a drill bit, a bolt, and an adaptor.

In some aspects, the drilling and bolting tool further includes a lock plate storage magazine supported on the frame, the lock plate magazine storing a plurality of lock plates, each of the lock plates configured to be positioned adjacent the cable.

In some aspects, the resin system includes a hose guide for directing the hose into the hole as the hose is extended.

In some aspects, the drill head includes a chuck for engaging a drill bit, the drill head being supported for translational movement relative to the frame along an axis.

In some aspects, at least a portion of the hose is supported on a reel, wherein the reel is supported on one of a chassis and a boom of mining machine.

In some aspects, the drilling and bolting tool further includes a screen handling device coupled to the frame.

In yet another aspect, a drilling and bolting tool includes: a drill feed for driving a bit to form a hole in a rock surface, the drill feed including a frame and a drill head supported on the frame, the drill head including a chuck for engaging a drill bit and a motor for rotating the chuck, the drill head supported for movement relative to the frame along an axis; and a cable feed system coupled to the frame, the cable feed system including a cable drive for driving a cable into the hole, a hydraulic actuator for applying tension on the cable, and a cutter configured to cut the cable at a position outside of the hole while leaving a portion of the cable within the hole.

In some aspects, the drilling and bolting tool further includes a consumables magazine supported on the frame, the magazine configured to store at least one of a drill bit, a bolt, and an adaptor.

In some aspects, the drilling and bolting tool further includes a lock plate storage magazine supported on the frame, the lock plate magazine storing a plurality of lock plates, each of the lock plates configured to be positioned adjacent the cable.

In some aspects, the drilling and bolting tool further includes a hose guide coupled to the drill feed, the hose guide configured to direct a hose into the hole as the hose is extended.

In some aspects, the drilling and bolting tool further includes a screen handling device coupled to the frame, the screen handling device including an actuator for engaging a portion of a screen.

In still another independent aspect, a drilling and bolting tool includes: a drill feed for driving a bit to form a hole in a rock surface, the drill feed including a frame and a drill head supported on the frame, the drill head including a chuck for engaging a drill bit and a motor for rotating the chuck, the drill head supported for movement relative to the frame along an axis; and a resin system including a resin supply, a hose in fluid communication with the resin supply, and a hose drive system for selectively extending the hose into the hole and retracting the hose from the hole.

In some aspects, the resin system includes a hose guide for directing the hose into the hole as the hose is extended.

In some aspects, the resin system includes a reel supporting at least a portion of the hose as the hose is extended and retracted, the reel supported on a chassis or a boom of mining machine.

In some aspects, the drilling and bolting tool further includes a consumables magazine supported on the frame, the magazine configured to store at least one of a drill bit, a bolt, and an adaptor.

In some aspects, the drilling and bolting tool further includes a lock plate storage magazine supported on the frame, the lock plate magazine storing a plurality of lock plates, each of the lock plates configured to be positioned adjacent the hole.

In some aspects, the drilling and bolting tool further includes a screen handling device coupled to the frame, the screen handling device including an actuator for engaging a portion of a screen.

Other aspects of the disclosure will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized to implement aspects of the disclosure. For example, "controllers" described in the specification may include one or more electronic processors or processing units, one or more computer-readable medium modules, one or more input/output interfaces, and various connections (for example, a system bus) connecting the components.

DETAILED DESCRIPTION

Figure 1:
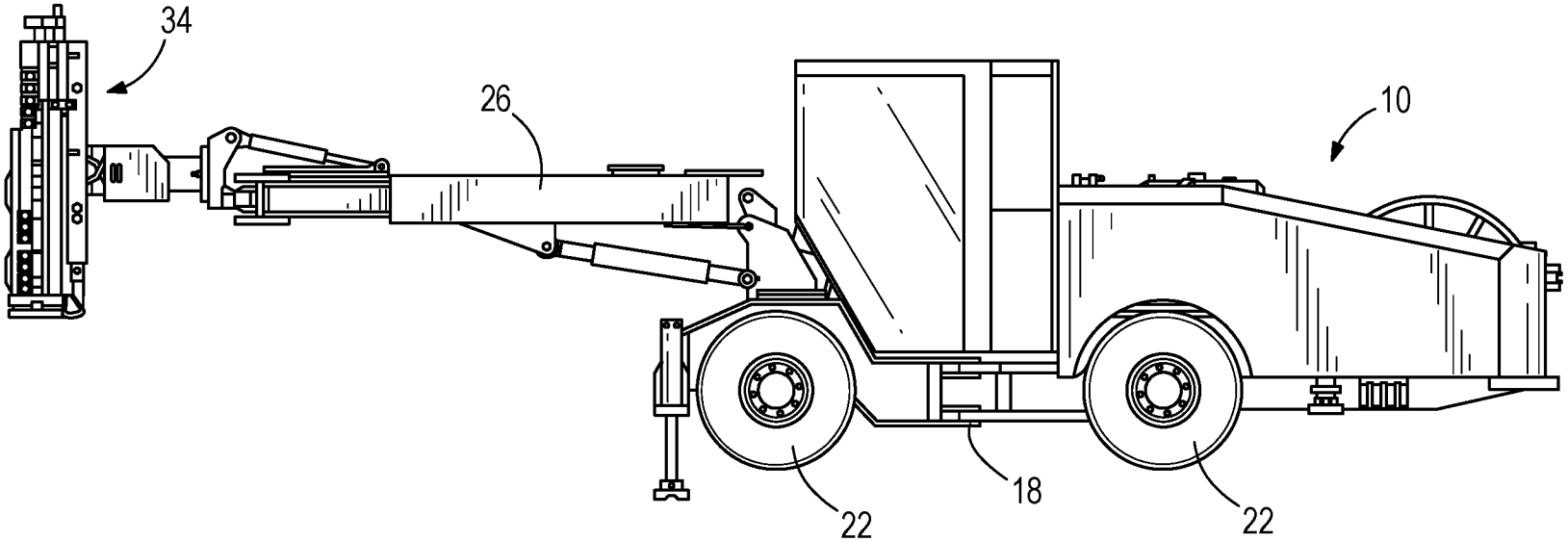
FIG. 1 is a side view of a drilling machine.
Figure 2:
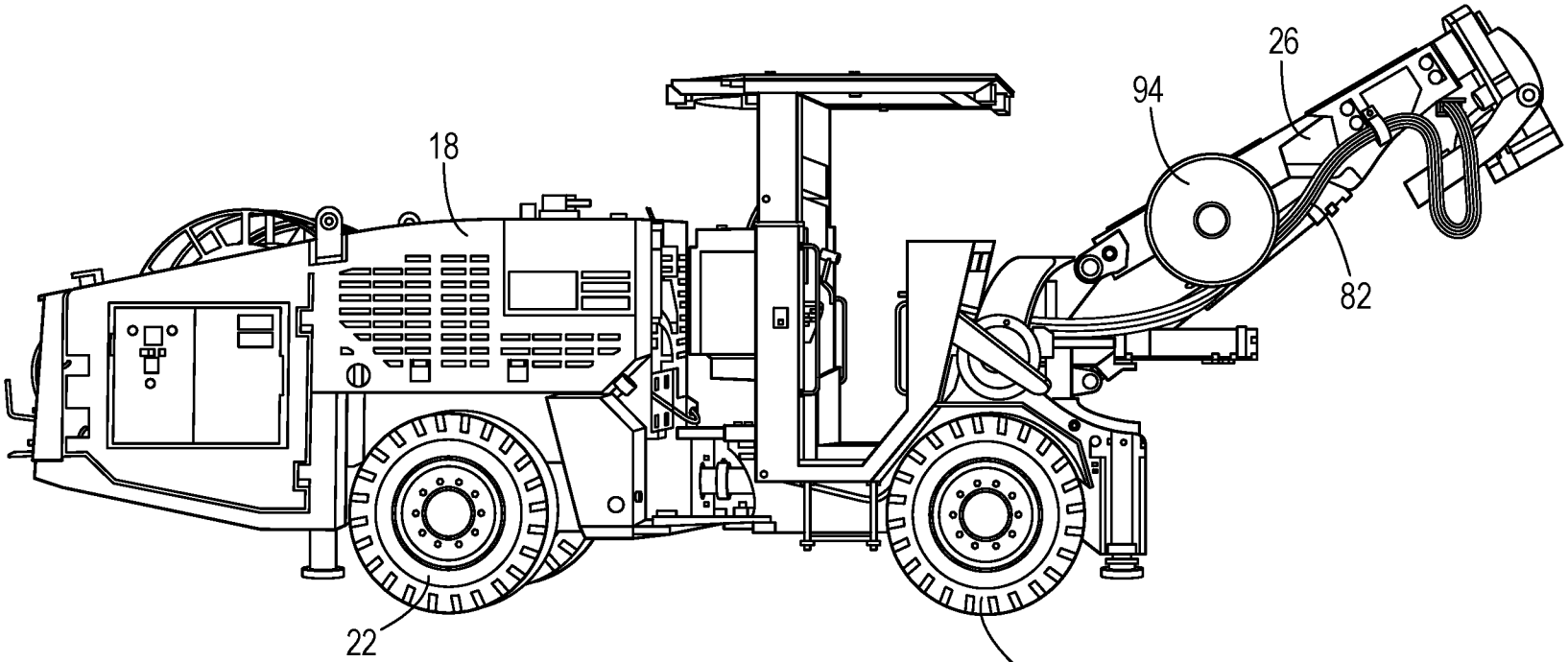
FIG. 2 is a side view of the drilling machine of FIG. 1.

FIGS. 1 and 2 illustrate a mobile mining machine 10, such as a drill jumbo or bolting machine. In the illustrated embodiment, the machine 10 includes a frame or chassis 18 supported by traction drive members 22 (e.g., wheels), and a support member or boom 26 coupled to the chassis 18. The boom 26 supports a drilling and bolting rig, or drill tool 34 (FIG. 1), for forming holes in a mine surface (e.g., a roof, a floor, or a rib or side wall—not shown) and/or installing a drill element (e.g., a bit or a bolt—not shown). In the illustrated embodiment, the drill tool 34 performs both drilling and bolting operations. Among other things, an installed bolt may anchor or support a safety mesh (not shown) to protect personnel against rock that may fall or become dislodged from the mine surface. Although the drill tool 34 is described in the context of the machine 10, it is understood that the drill tool 34 may be mounted on another type of machine, such as an entry development machine or a continuous mining machine (not shown).

Figure 3:
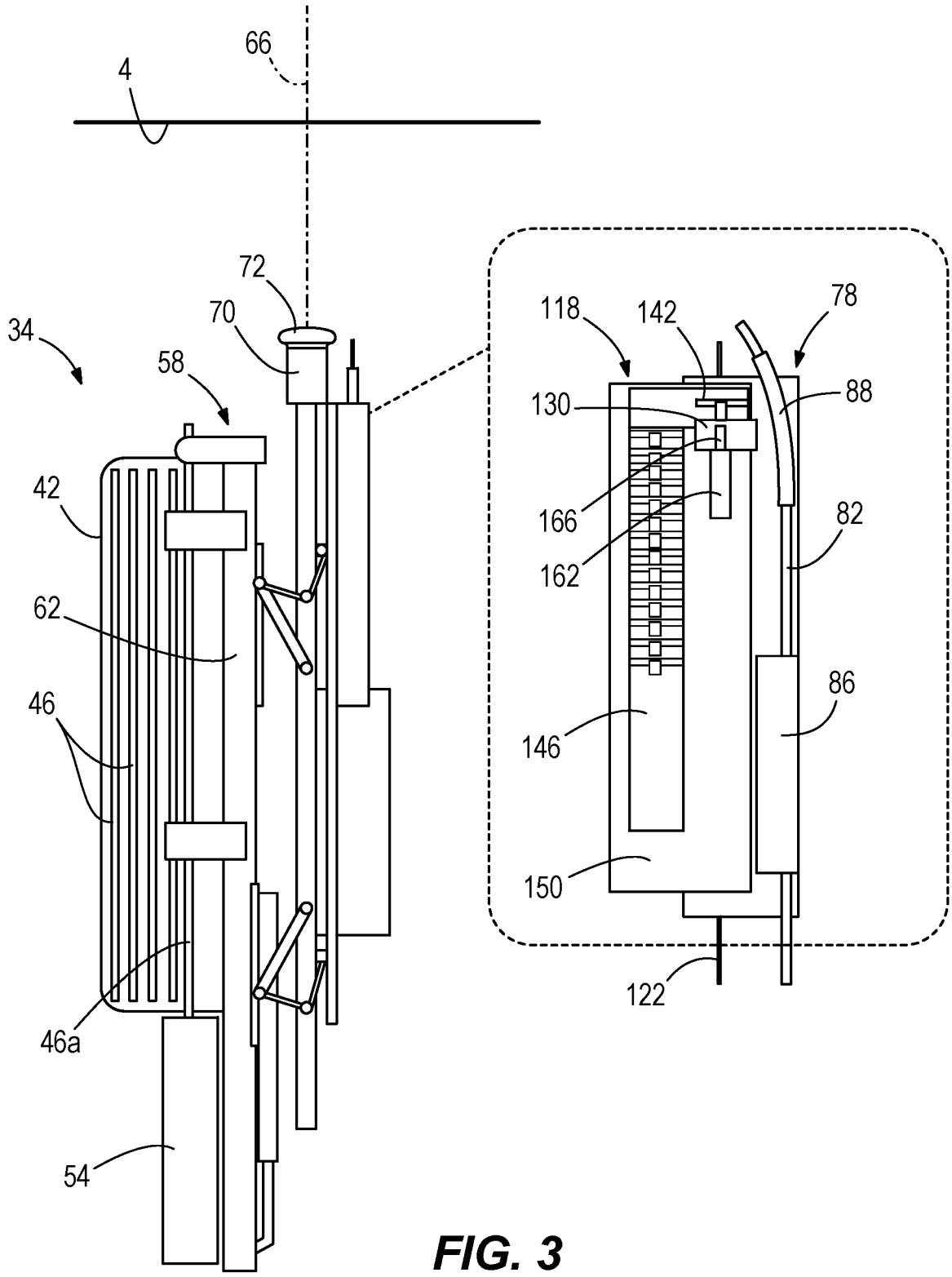
FIG. 3 is a schematic side view of a drill rig.

FIG. 3 illustrates a schematic side view of the drill tool 34, which is operable to drill a hole into a work surface 4 (e.g., a mine side wall, a mine roof, etc.). The drill tool 34 includes a feed assembly 58 that is operable to drive a consumable 46 (e.g., drill bit, bolt, resin cartridge, adaptor, expendable, self-drilling bolt, combined bolt-and-resin type bolt, extension drill rod, etc.) toward the work surface 4. The feed assembly 58 includes a frame 62 and a drill head 54. The drill head 54 is supported for movement relative to the frame 62. Although the frame 62 is illustrated as a unitary structure, it is understood that the frame 62 may include one or more telescoping portions, and the frame 62 may include one or more frame portions or stages (e.g., a base frame and a feed frame that is movable relative to the base frame) that are movable relative to one another. For example, the frame portions/stages may be movable relative to each other by one or more hydraulic actuators (e.g., hydraulic cylinders). Also, the drill head 54 may be movable along a length of the frame 62. The drill head 54 may include a chuck or jaw (e.g., for receiving a portion of a drill bit or bolt) and a motor for rotating the chuck. The drill head 54 is operable to drive the consumable 46 toward the work surface 4, and the drill head 54 may translate relative to the frame 62 in a direction parallel to a drill axis 66. In some embodiments, the drill head 54 may be driven relative to the frame 62 by a chain drive mechanism; in other embodiments, the drill head 54 may be driven relative to the frame 62 by one or more hydraulic actuators. In some embodiments, the drill head 54 may include a percussive device (e.g., a hammer) to assist in driving the bit into the work surface 4 to form a hole 8.

The drill tool 34 may include a storage member 42 (e.g., a carousel or magazine) that includes consumables 46 (e.g., drill bits, bolts, resin cartridges, adaptors, expendables, self-drilling bolts, combined bolt-and-resin type bolts, extension drill rods, etc.). The drill tool 34 may also include a loading mechanism (e.g., a rod handler or loading arm 36—FIG. 8) that retrieves one of the consumables 46*a* from the storage member 42 and loads the consumable 46 into the drill head 54. In addition, the drill tool 34 may include a screen handling device 70 for engaging and holding a screen in a desired position. For example, the screen handling device 70 may include an end surface 72 and an actuator (not shown) for clamping a portion of the screen against the end surface 72, and the screen handling device 70 may manipulate the screen as needed and position the screen against the work surface 4 while a bolt is inserted. In some embodiments, the drill tool 34 minimizes manual interaction by a human operator and improves overall efficiency and safety of a drilling and bolting operation.

Figure 4:
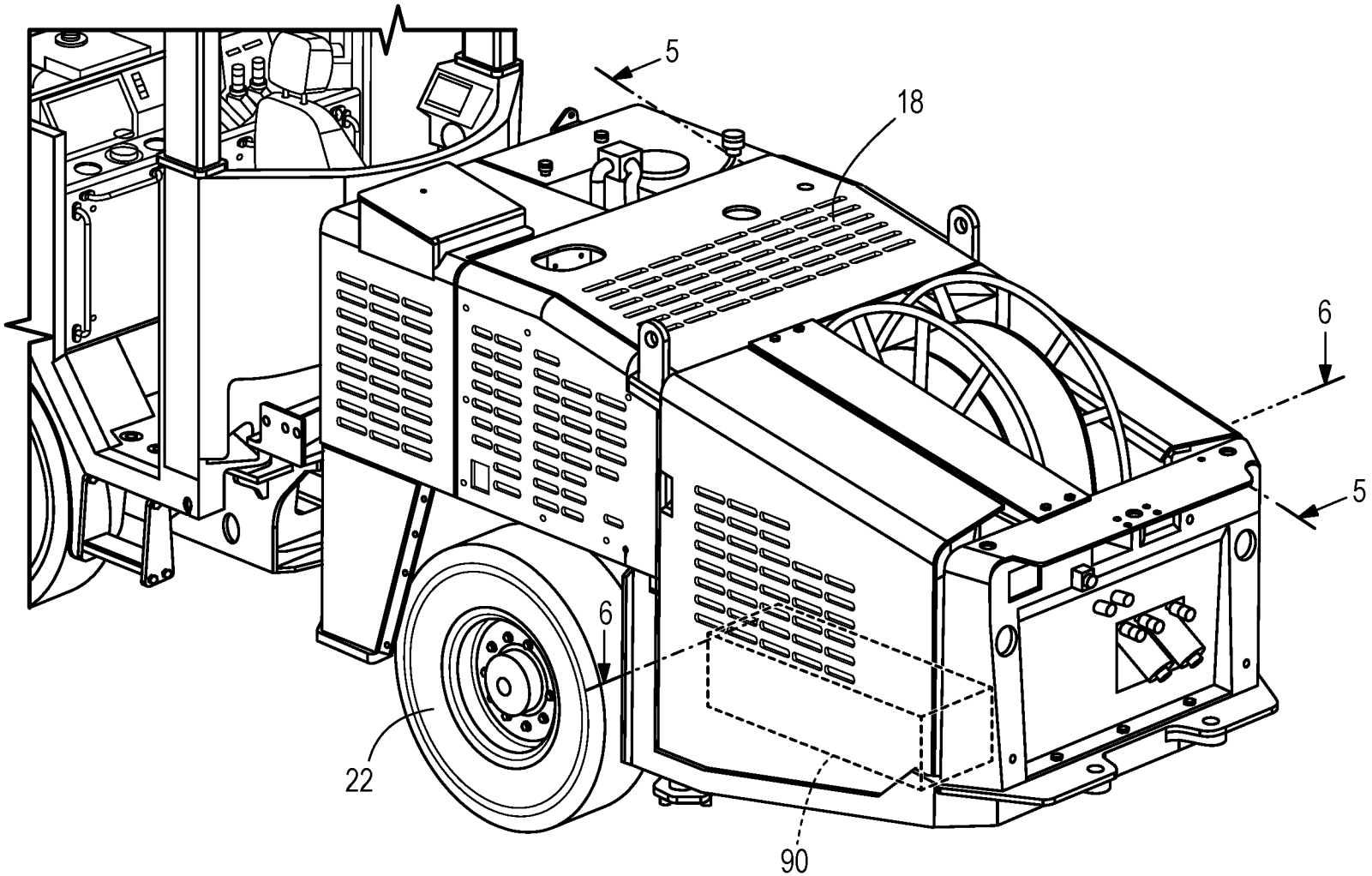
FIG. 4 is a perspective view of a portion of the drilling machine of FIG. 2.
Figure 6:
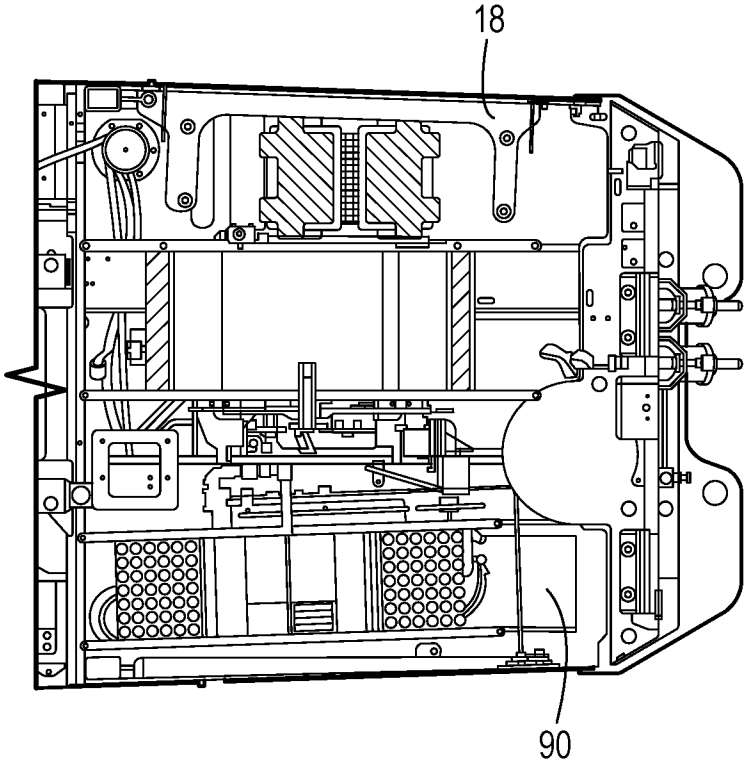
FIG. 6 is a section view of the drilling machine of FIG. 4, viewed along section 6-6.
Figure 5:
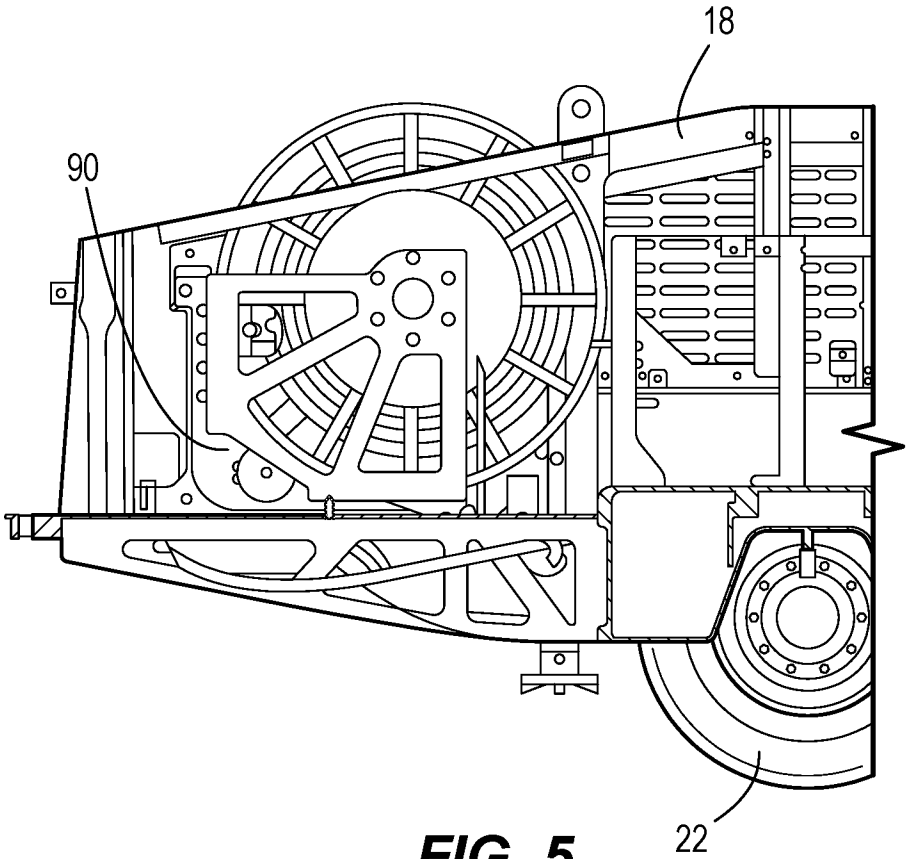
FIG. 5 is a section view of the drilling machine of FIG. 4, viewed along section 5-5.

The drill tool 34 further includes a resin system 78. The resin system 78 includes a hose 82, a hose driving device 86, and a hose guide 88. The hose driving device 86 may include one or more belts and/or pulleys that engage an outer surface of the hose 82 and move the hose 82. In the illustrated embodiment, as the hose 82 is driven toward the work surface 4, the hose 82 engages the hose guide 88 to align the hose 82 in a desired orientation (e.g., to align with a center of a cable or the drill axis 66). The hose 82 is in fluid communication with one or more supply reservoirs 90 (FIG. 4) in which chemicals are stored and one or more pumps. As shown in FIGS. 4-6, in the illustrated embodiment, the supply reservoirs 90 are supported on the chassis 18 of the machine 10. The machine 10 may also support one or more spools 94 (FIG. 2) that support the hose 82 while the hose 82 is in fluid communication with the reservoirs 90. In some embodiments, the hose 82 is at least partially wrapped onto the spool(s) 94, and the spool(s) 94 can be driven (e.g., by a motor) to rotate to reel in or pay out the hose 82. In some embodiments, the spool 94 may be supported on the boom 26 (FIG. 2).

Figure 7:
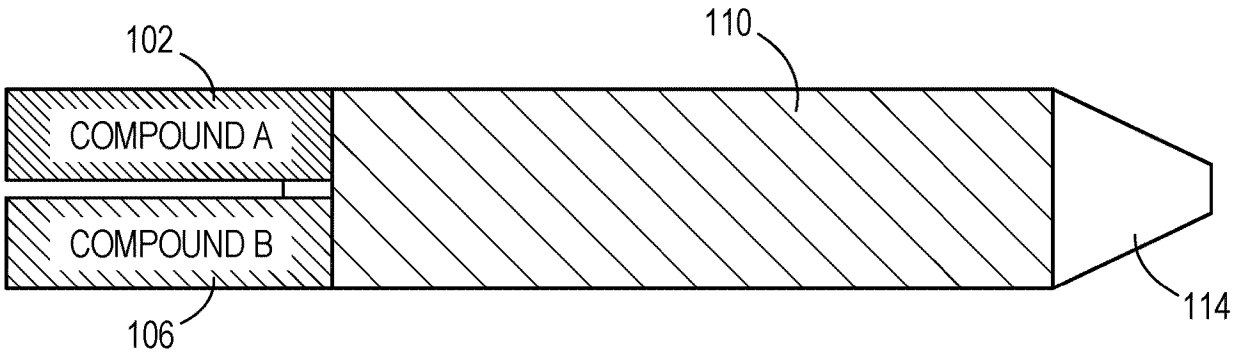
FIG. 7 is a schematic view of a hose.

As shown in FIG. 7, in the illustrated embodiment, the hose 82 includes a first tube 102, a second tube 106, and a mixing chamber 110 positioned adjacent a dispensing nozzle 114. The first tube 102 supplies a first chemical (e.g., a resin) and the second tube 106 supplies a second chemical (e.g., a catalyst or curing agent), and the first chemical and the second chemical mix in the mixing chamber 110 as they are driven through the nozzle 114 and into the hole (FIG. 3). The mixing chamber 110 may include a diffusing device (not shown) to facilitate intermixing of the first chemical and the second chemical. After a resin dispensing operation, one of the chemicals may be flushed through the mixing chamber 110 to ensure that no residual mixed compound remains in the mixing chamber 110 and/or diffusing device.

Referring again to FIG. 3, the drill tool 34 further includes a cable feeding system 118. The cable feeding system 118 includes a cable 122 (e.g., a multi-strand cable) that is driven (e.g., through a guide tube) toward the work surface 4. The cable feeding system 118 further includes a cutter 130 positioned adjacent an end of the drill tool 34, and a tensioning device. In the illustrated embodiment, lock plates/wedges 142 are stored in a plate storage magazine 146 and can be positioned adjacent the end of the drill tool 34. An end of the cable 122 passes through the plate 142 before passing into the drilled hole 8 in the work surface 4. In the illustrated embodiment, the cutter 130, tensioning device 138, and plate storage magazine 146 are supported on a feed table 150. The cutter 130 may include a pair of blades positioned in a scissor-like arrangement, and the blades may be driven by a hydraulic actuator (e.g., a hydraulic cylinder) to cut the cable 122 after a predetermined length has been inserted into the hole 8.

In some embodiments, the tensioning device includes a hollow hydraulic actuator through which the cable 122 may pass. The hydraulic actuator includes a first portion 162, and a second portion 166 that is extendable (e.g., hydraulically driven) relative to the first portion 162. The first portion 162 may include one or more no-slip or anti-reverse jaws to engage and grip a portion of the cable 122. In the illustrated embodiment, the tensioning device 138 may include a second set of anti-reverse jaws to permit movement of the cable 122 in one direction only (e.g., the advancing direction). Extension of the second portion 166 relative to the first portion 162 may exert a tension on the cable 122.

Figure 8:
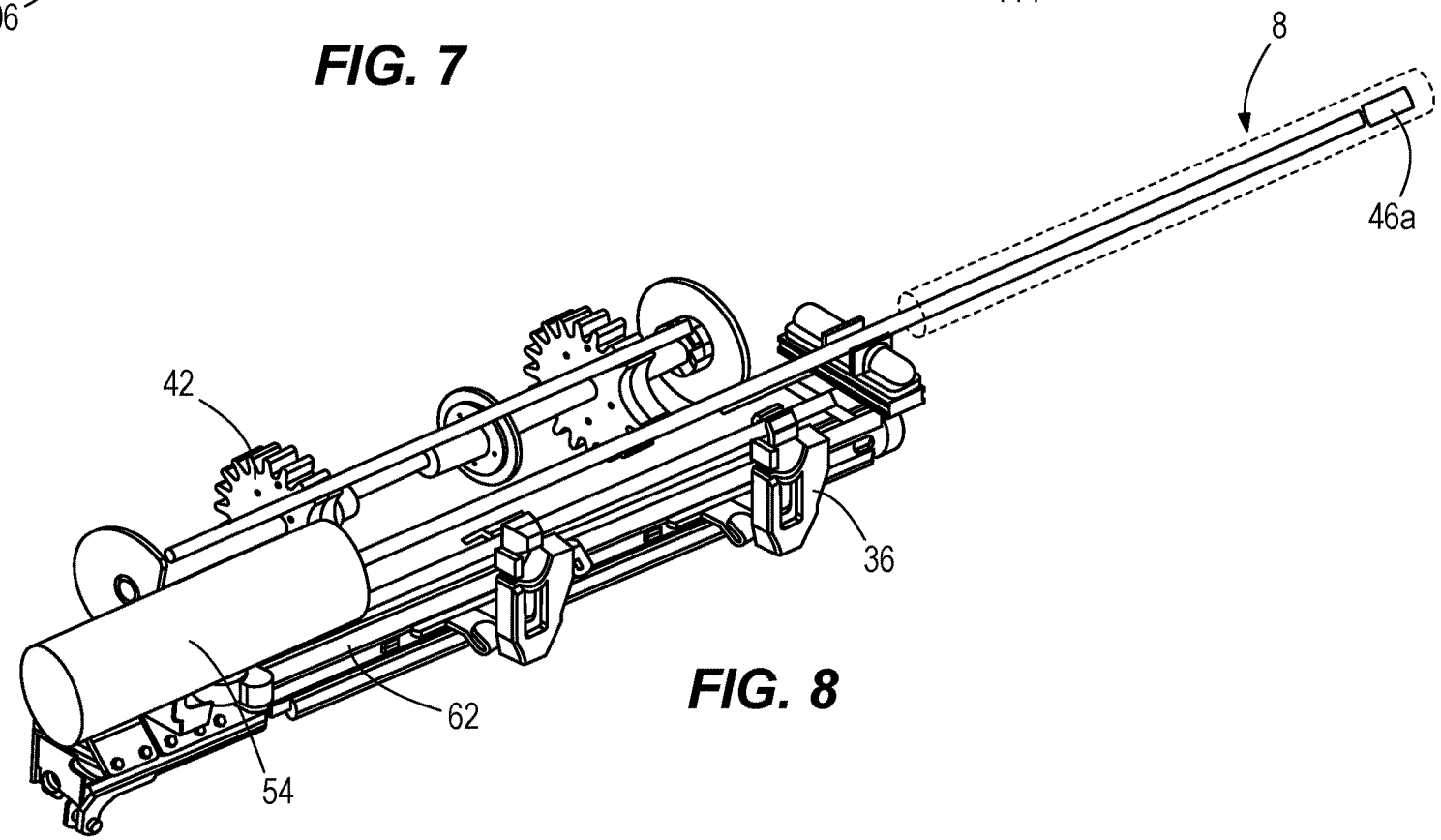
FIG. 8 is a perspective view of a drill rig during formation of a hole.
Figure 9:
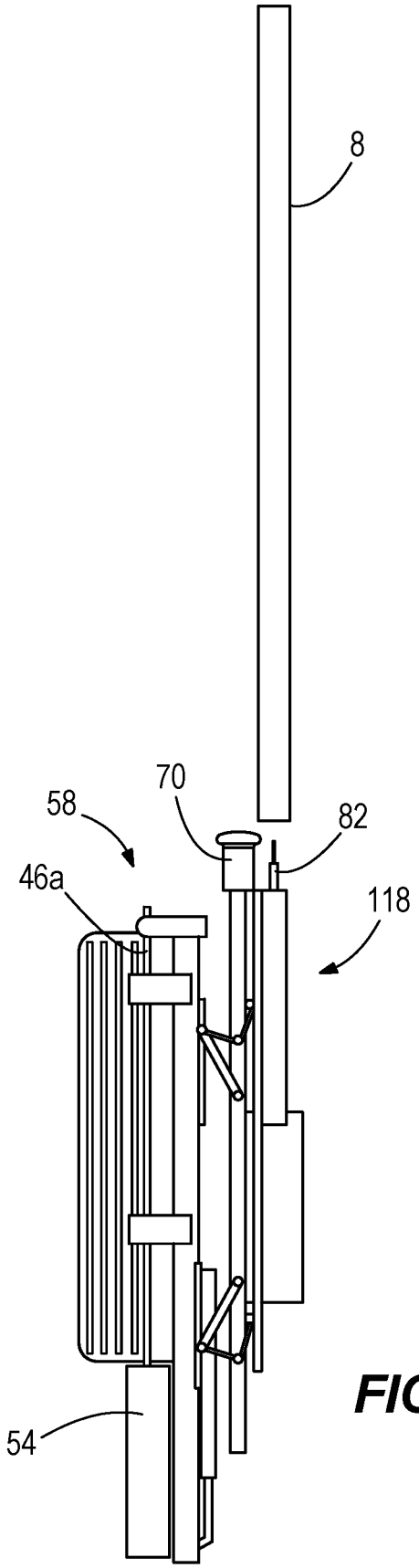
FIG. 9 is a schematic side view of the drill rig of FIG. 3, after retraction of a drill bit from a hole.
Figure 10:
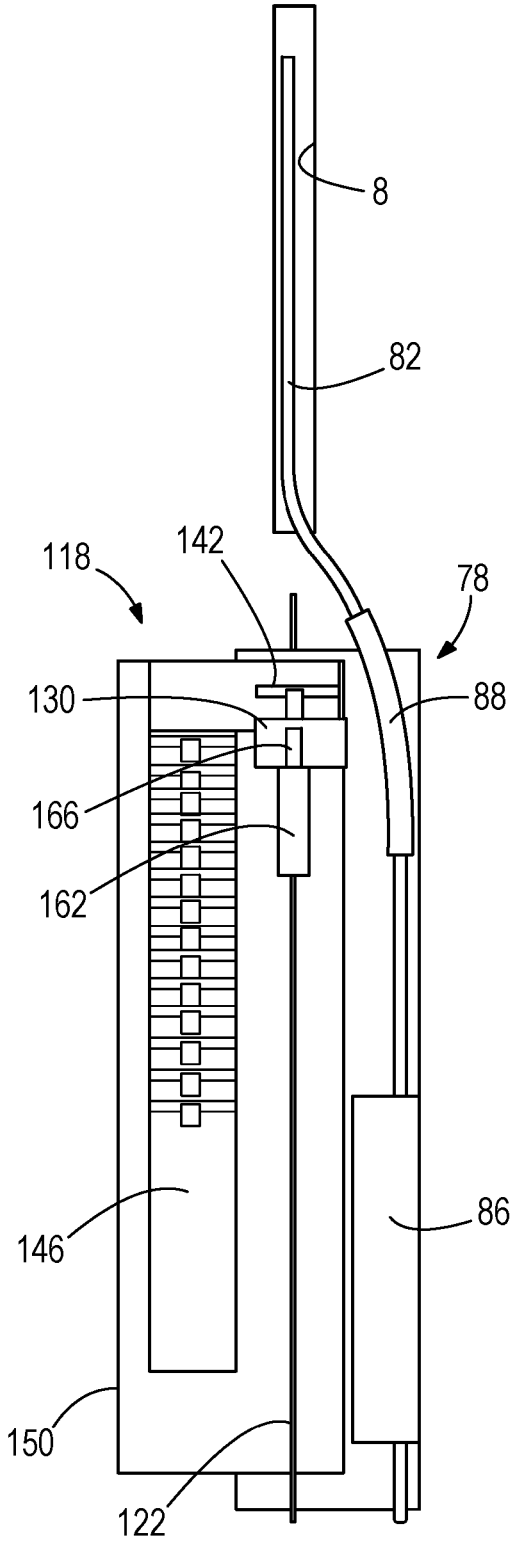
FIG. 10 is a schematic side view of the drill rig of FIG. 9, with a hose inserted into the hole.
Figure 11:
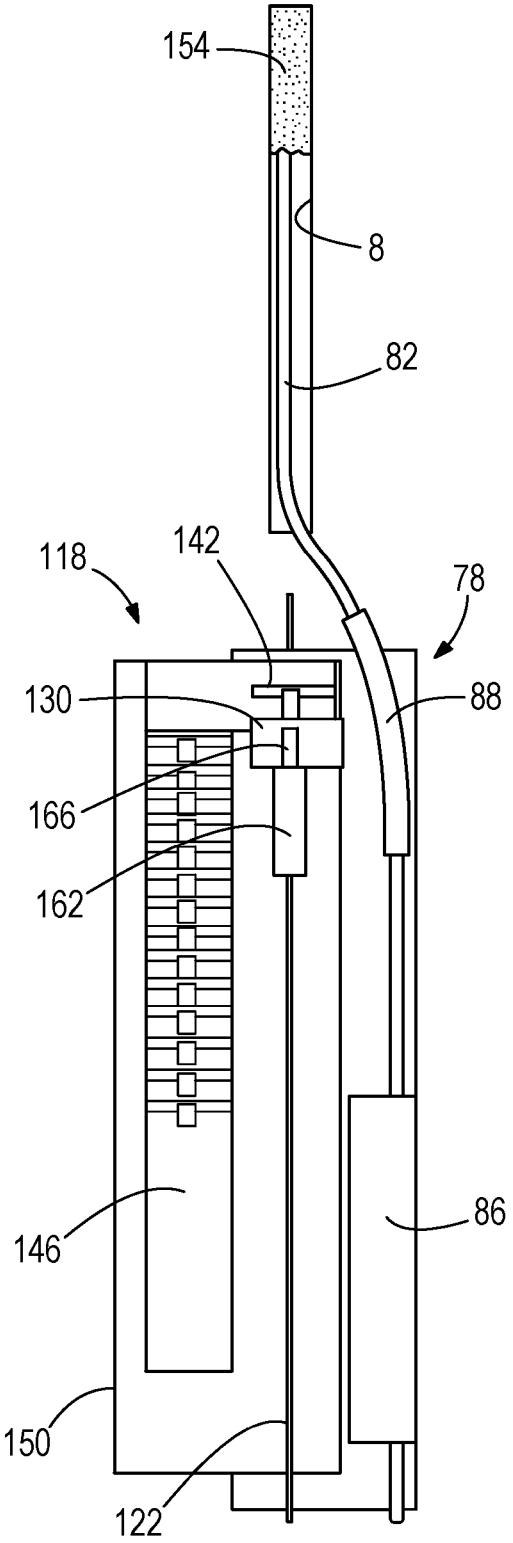
FIG. 11 is a schematic side view of the drill rig of FIG. 10, with resin dispensed from the hose.

FIGS. 8-13 illustrate an operation cycle for the drill tool 34. The drill tool 34 is positioned adjacent the work surface 4 (FIG. 3). As shown in FIG. 8, the drill head 54 is operated to drive a drill bit **46*a* into the work surface 4 to form the hole 8. The drill bit 46*a* may then be removed from the hole 8. As shown in FIG. 9, the drill tool 34 is moved to align the resin system 78 with the drill hole 8. In some embodiments, the drill tool 34 may be indexed or rotated to align the resin system 78 without re-positioning the boom 26. The hose driving device 86 is operated to extend the hose 82 into the drilled hole 8 (FIG. 10), and then resin 154 is injected into the hole 8 (FIG. 11). The resin may be mixed with a curing agent as discussed above prior to being dispensed from a nozzle. In other embodiments, the resin and curing agent may each be injected directly into the hole 8 simultaneously and may intermix in the hole 8. The hose 82 may be retracted as the hole 8** is filled.

Figure 12:
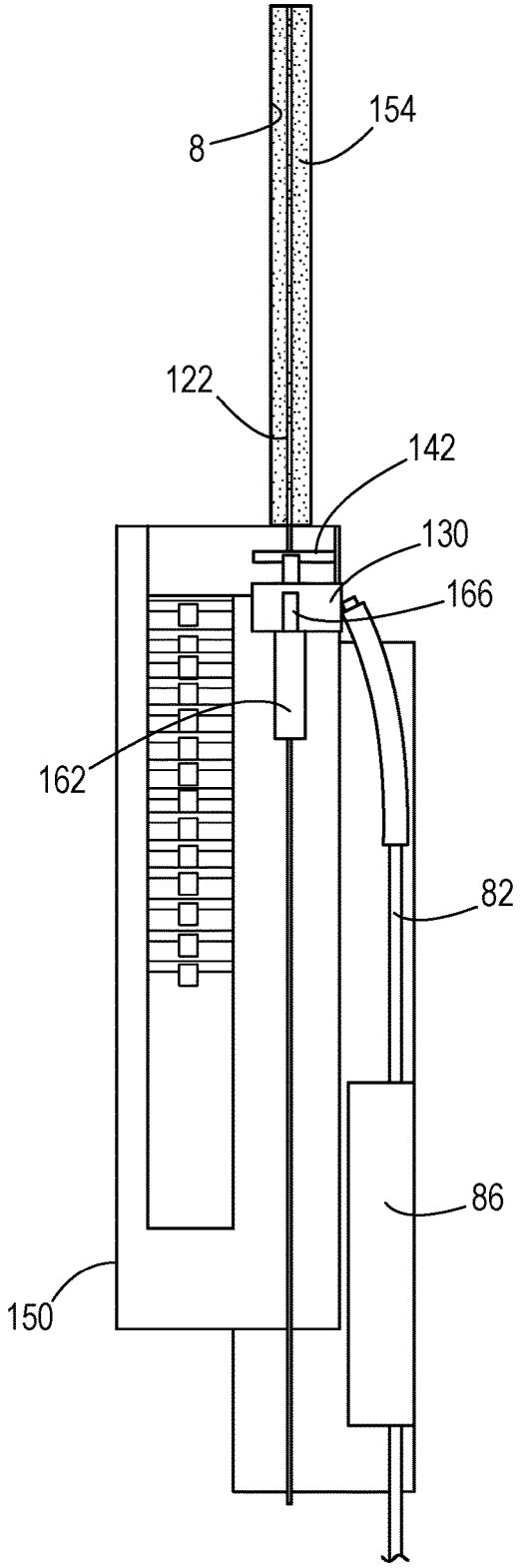
FIG. 12 is a schematic side view of the drill rig of FIG. 11, with a bolt inserted into the hole.
Figure 13:
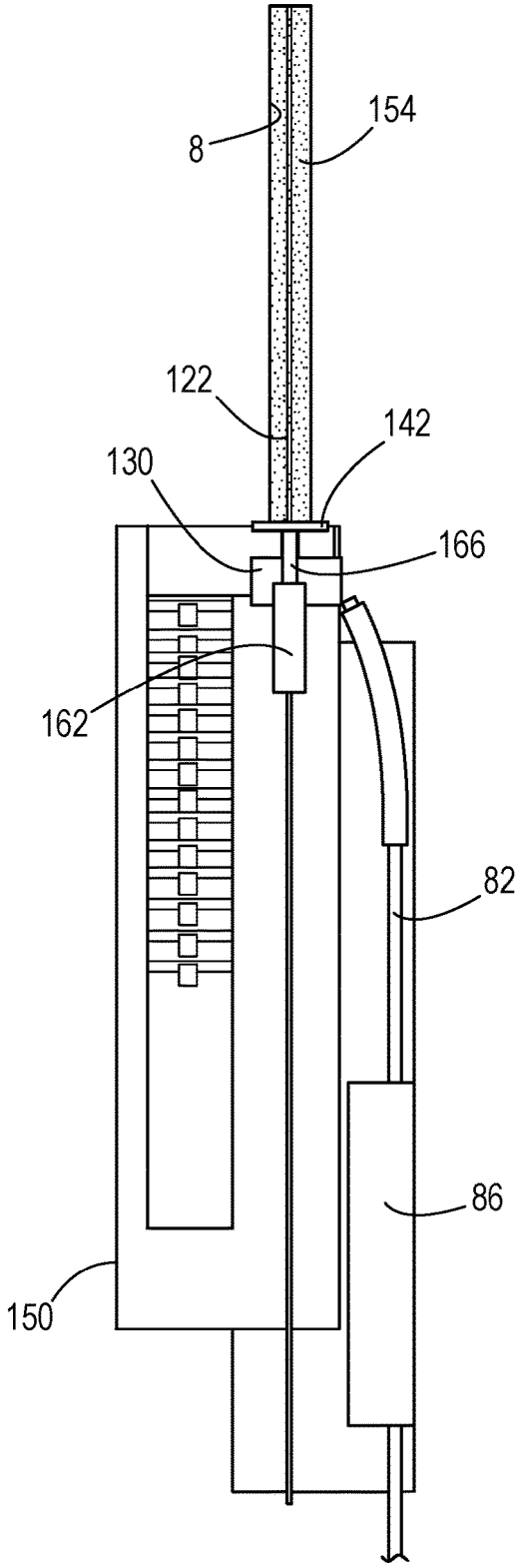
FIG. 13 is a schematic side view of the drill rig of FIG. 12, with tension applied to the bolt.

Referring now to FIG. 12, one of the lock plates/wedges 142 is positioned adjacent the hole 8 (for example, the lock plate/wedge 142 may be retrieved from the plate storage magazine 146). The cable 122 is driven through the lock plate/wedge 142 and into the drilled hole 8. In some embodiments, the cable 122 may be rotated as it is inserted in order to facilitate mixing of the resin and curing agent. The feed table 150 may be extended to be positioned adjacent the drilled hole 8. As shown in FIG. 13, the first portion 162 of the tensioning device 138 (e.g., a hydraulic cylinder) grips or engages a portion of the cable 122, and the second portion 166 is extended to drive the lock plate/wedge 142 toward the drilled hole 8. As a result, the tensioning device 138 imparts a pre-load tension on the cable 122. Once the second portion 166 is retracted, the cutter 130 is actuated to cut the exposed end of the cable 122. Fraying of the cable 122 is prevented due to the cable 122 being gripped by the tensioning device 138. In some embodiments, after the cable 122 is cut, another lock plate/wedge 142 may be reloaded from the plate storage magazine 146 into a position adjacent the end of the feed table 150 in preparation for a subsequent operation.

Although aspects have been described in detail with reference to certain embodiments, variations and modifications exist within the scope and spirit of one or more independent aspects as described.

What is claimed is:

1. A drilling and bolting tool supported by a boom of a mining machine, the drilling and bolting tool comprising:

a drill feed for driving a bit to form a hole in a rock surface, the drill feed including a frame and a drill head supported on the frame;

a cable feed system coupled to the drill feed, the cable feed system including a cable drive for driving a cable into the hole; and a resin system coupled to the drill feed, the resin system including a hose in fluid communication with a resin supply, the resin system further including a hose drive system for selectively extending the hose into the hole and retracting the hose from the hole, wherein the cable feed system further includes a tensioning device for applying tension on the cable and a cutter configured to cut the cable while under the tension at a position outside of the hole while leaving a portion of the cable within the hole.

2. The drilling and bolting tool of claim 1, wherein the tensioning device includes a hydraulic actuator for applying the tension on the cable.

3. The drilling and bolting tool of claim 2, wherein the hydraulic actuator is a hollow hydraulic actuator, wherein the cable extends through the hollow hydraulic actuator, wherein the hydraulic actuator includes a first portion and a second portion extendable relative to the first portion, and wherein the first portion is configured to engage the cable such that extension of the second portion applies the tension on the cable.

4. The drilling and bolting tool of claim 1, further comprising a consumables magazine supported on the frame, the consumables magazine configured to store at least one of a drill bit, a bolt, and an adaptor.

5. The drilling and bolting tool of claim 1, further comprising a lock plate storage magazine supported on the frame, the lock plate storage magazine storing a plurality of lock plates, each of the lock plates configured to be positioned adjacent the cable.

6. The drilling and bolting tool of claim 1, wherein the resin system includes a hose guide for directing the hose into the hole as the hose is extended.

7. The drilling and bolting tool of claim 1, wherein the drill head includes a chuck for engaging a drill bit, the drill head being supported for translational movement relative to the frame along an axis.

8. The drilling and bolting tool of claim 1, wherein at least a portion of the hose is supported on a reel, wherein the reel is supported on one of a chassis and the boom of the mining machine.

9. The drilling and bolting tool of claim 1, further comprising a screen handling device coupled to the frame.

10. A drilling and bolting tool supported by a boom of a mining machine, the drilling and bolting tool comprising:

a drill feed for driving a bit to form a hole in a rock surface, the drill feed including a frame and a drill head supported on the frame, the drill head including a chuck for engaging a drill bit and a motor for rotating the chuck, the drill head supported for movement relative to the frame along an axis;

a resin system coupled to the drill feed, the resin system including a hose in fluid communication with a resin supply;

a cable feed system coupled to the frame, the cable feed system including a cable drive for driving a cable into the hole, a hydraulic actuator for applying tension on the cable, and a cutter configured to cut the cable at a position outside of the hole while leaving a portion of the cable within the hole; and a drill tool supporting the drill feed, the resin system, and the cable feed system, wherein the drill tool is movable to selectively align the resin system with the hole in the rock surface without repositioning the boom supporting the drill tool after forming the hole via the drill feed.

11. The drilling and bolting tool of claim 10, further comprising a consumables magazine supported on the frame, the consumables magazine configured to store at least one of a drill bit, a bolt, and an adaptor.

12. The drilling and bolting tool of claim 10, further comprising a lock plate storage magazine supported on the frame, the lock plate storage magazine storing a plurality of lock plates, each of the lock plates configured to be positioned adjacent the cable.

13. The drilling and bolting tool of claim 10, further comprising a hose guide coupled to the drill feed, the hose guide configured to direct the hose into the hole as the hose is extended.

14. The drilling and bolting tool of claim 10, further comprising a screen handling device coupled to the frame, the screen handling device including an actuator for engaging a portion of a screen.

15. A method of operating a drilling and bolting tool, the drilling and bolting tool including a boom supporting a drill tool that includes a drill feed, a cable feed system, and a resin system, the method comprising:

positioning the drill tool adjacent to a work surface such that the drill feed is substantially aligned with a desired location;

operating a drill head of the drill tool to drive a drill bit into the work surface to form a hole at the desired location;

moving the drill tool without repositioning the boom such that the resin system is substantially aligned with the hole;

operating the resin system to inject resin into the hole;

operating the cable feed system to drive a cable into the hole;

engaging a portion of the cable outside of the hole with a tensioning device of the cable feed system to apply tension to the cable; and actuating a cutter of the cable feed system to cut an exposed end of the cable while under the tension.

16. The method of claim 15, wherein moving the drill tool without repositioning the boom comprises rotating the drill tool.

17. The method of claim 15, wherein moving the drill tool without repositioning the boom comprises indexing the drill tool.

18. The method of claim 15, wherein operating the resin system to inject resin into the hole further comprises:

operating a hose driving device of the resin system to extend a hose having a nozzle into the hole;

injecting resin into the hole via the nozzle; and retracting the hose from the hole, wherein the resin mixes with a curing agent either prior to or after being ejected from the nozzle.

19. The method of claim 15, wherein the drill tool further comprises a lock plate storage magazine retaining a plurality of lock plates, each lock plate configured to be positioned adjacent the hole.

* * * * *